US009565722B2

(12) United States Patent
Talavera González et al.

(10) Patent No.: US 9,565,722 B2
(45) Date of Patent: Feb. 7, 2017

(54) MODULE FOR AN LED LAMP THAT ALLOWS FOR TWO DIFFERENT TYPES OF CONNECTIONS TO POWER WITH SUFFICIENT HEAT DISSIPATION CAPACITY

(75) Inventors: Néstor Talavera González, Guadalupe (MX); Arturo Ángel Barrios Muñoz, Monterrey (MX); Oscar René Cavazos Ramos, San Nicolas de los Garza (MX); Luis Rebolledo Salazar, Monterrey (MX)

(73) Assignee: CEMM MEX, S.A. DE C.V., Guadalupe (MX)

( * ) Notice: Subject to any disclaimer, the term of this patent is extended or adjusted under 35 U.S.C. 154(b) by 0 days.

(21) Appl. No.: 14/374,847

(22) PCT Filed: Feb. 16, 2012

(86) PCT No.: PCT/MX2012/000017
§ 371 (c)(1),
(2), (4) Date: Oct. 3, 2014

(87) PCT Pub. No.: WO2013/112037
PCT Pub. Date: Aug. 1, 2013

(65) Prior Publication Data

US 2015/0069901 A1 Mar. 12, 2015

(30) Foreign Application Priority Data

Jan. 27, 2012 (MX) ..... MX/a/2012/001219

(51) Int. Cl.
*F21V 7/07* (2006.01)
*H05B 33/06* (2006.01)
(Continued)

(52) U.S. Cl.
CPC ..... *H05B 33/06* (2013.01); *F21S 48/212* (2013.01); *F21S 48/215* (2013.01); *F21S 48/328* (2013.01); *F21V 29/20* (2013.01); *H01R 33/09* (2013.01)

(58) Field of Classification Search
CPC ..... H01R 33/09; H05B 33/06; F21V 29/20; F21V 19/001; F21V 21/002; F21V 29/004; B60Q 1/2696; F21S 48/212; F21S 48/215; F21S 48/328
(Continued)

(56) References Cited

U.S. PATENT DOCUMENTS 6,345,902 B2 2/2002 Ohkohdo et al.
7,001,046 B2 2/2006 Kaga et al.
(Continued)

FOREIGN PATENT DOCUMENTS

CN 101834399 A 9/2010
EP 1724516 A1 11/2006
(Continued)

OTHER PUBLICATIONS

Office Action issued in Japanese Patent Application No. 2014-554680, mailed on Nov. 16, 2015.
(Continued)

*Primary Examiner* — Tracie Y Green
(74) *Attorney, Agent, or Firm* — Knobbe, Martens, Olson & Bear LLP

(57) ABSTRACT

This invention is a device or module with a LED-type lamp of compact dimensions in order to be used in different illumination industries, such as the automobile, signaling or architectonic industries. The module includes elements for its easy and fast attachment, an efficient manufacturing as from a single plate and structures for the structural support and for heat diffusion. It can be directly attached in an application or in an insulation material support. Likewise, it
(Continued)

has two different types of connections that may be used independently or jointly depending on the application.

11 Claims, 13 Drawing Sheets

(51) Int. Cl.
*H01R 33/09* (2006.01)
*F21S 8/10* (2006.01)
*F21V 29/00* (2015.01)

(58) Field of Classification Search
USPC ..... 313/46; 362/249
See application file for complete search history.

(56) References Cited

U.S. PATENT DOCUMENTS

| | | | | |
|---|---|---|---|---|
| 7,137,852 | B2 | 11/2006 | Tsukamoto | |
| 7,341,371 | B2 | 3/2008 | Kuo et al. | |
| 7,742,306 | B2 * | 6/2010 | Shuai et al. | 361/710 |
| 7,766,514 | B2 * | 8/2010 | Chen | 362/294 |
| 8,128,427 | B2 | 3/2012 | Mochizuki | |
| 8,277,093 | B2 | 10/2012 | Mochizuki | |
| 8,562,176 | B2 | 10/2013 | Grauvogel | |
| 2003/0058650 | A1 | 3/2003 | Shih | |
| 2003/0218417 | A1 * | 11/2003 | Chin | 313/498 |
| 2005/0281032 | A1 | 12/2005 | Petersen | |
| 2007/0091604 | A1 | 4/2007 | Kuo et al. | |
| 2007/0201232 | A1 * | 8/2007 | Chen | 362/294 |
| 2007/0259576 | A1 * | 11/2007 | Brandt et al. | 439/885 |
| 2009/0009977 | A1 * | 1/2009 | Enomoto et al. | 361/749 |
| 2010/0142218 | A1 * | 6/2010 | Middy | 362/543 |
| 2010/0210133 | A1 | 8/2010 | Mochizuki | |
| 2010/0226140 | A1 | 9/2010 | Mochizuki | |

FOREIGN PATENT DOCUMENTS

| | | | |
|---|---|---|---|
| EP | 2177823 | A1 | 4/2010 |
| FR | 2880734 | A1 | 7/2006 |
| JP | 2005-217354 | A | 8/2005 |
| JP | 2006-260835 | A | 9/2006 |
| JP | 2006-286461 | A | 10/2006 |
| JP | 2006-294502 | A | 10/2006 |
| JP | 2007-018762 | A | 1/2007 |
| JP | 2009-285277 | A | 12/2009 |
| JP | 2010-212322 | A | 9/2010 |
| JP | 2010-251296 | A | 11/2010 |

OTHER PUBLICATIONS

International Search Report re International Application No. PCT/MX2012/000017, mailed Oct. 22, 2012, in 2 pages.

* cited by examiner

MODULE FOR AN LED LAMP THAT ALLOWS FOR TWO DIFFERENT TYPES OF CONNECTIONS TO POWER WITH SUFFICIENT HEAT DISSIPATION CAPACITY

PURPOSE OF THE INVENTION

The purpose of this invention is to have a device or module in which a LED-type ("light emitting diode) lamp may be attached, which has a compact form, heat dissipation high capacity and that, at the same time, offers different electric connection modalities, different types of quick and practical attachment types for the industry of illumination in general and specifically to the automobile illumination industry.

BACKGROUND

With the appearance of the light emitting diodes, also known as LEDS, it has been sought to replace the traditional illumination systems such as incandescent or fluorescent lamps.

The LED type lamps offer superior qualities to the other types of luminaries. Among these is a considerably higher useful life time than the incandescent or fluorescent illumination systems. Likewise, their operation is more efficient in energetic terms and due to the nature of its construction, the light emission is more expedite than the traditional systems.

For these and other reasons, the LED type illumination systems are being adopted as a base for the illumination in different industrial, residential and commercial applications. Among others, the automobile industry plays an important role in the adoption of LED illumination for the inner illumination of vehicles, in the luminaries and external lamps such as in the main lights.

The light emission diodes or LEDS contain of two electrical terminals for the energy feeding. Through these terminals, the LED is provided with the voltage necessary for its activation and with this the light emission is obtained.

There are several forms of joining these terminals to electrical circuits. Among the most common forms is the welding of the terminals to an electrical plate. The welding physically anchors the LED to the circuit, allowing the flow of electricity of the circuit to the diode.

Other form of union is the mechanical union, in which the LED is mechanically attached to conductor elements. In the current state of the art there are techniques to staple the LED to conductor plates, which permanently join the anode and cathode to the plate's arrays for specific applications.

In addition to the rigid arrays, there are flexible unions (flexboards) and by conductor cables, however, these present some limitations such as high cost for efficient heat dissipation.

Among the most common techniques in the automobile industry is the stapling of the LED to conductor plates. Document EP 0653586 offers a technique of a multiple-LEDS arrays mechanically joined to a distribution plate or bar. In automobile applications, these bars are formed and are adequate to the form of the lamp or luminary in which it is going to be placed.

This type of rigid attachment and as the one illustrated in patent CA 2562357 offer an adequate attachment and conduction for the LED, but their construction is unpractical and difficult to change once the distribution bar has been designed.

In low-potency applications, there are modules in which the LED has been attached in supports for a fast fixing.

These modules, illustrated in patents such as application JP19990197790 19990712 and EP 2 177 823 A1 offer some practicity but little flexibility in the connections. Application US2005/0063181A1 offers a form of fast connection to cables by the displacement of the insulation, but, as the other two, it has a limited capacity with regard to the connections and in all cases present a very limited heat dissipation capacity.

This invention presents the integration of the LED in a full module, in which the LED diode is fixed to an anode and cathode with specific forms that allow two types of connections in addition to a sufficient heat dissipation capacity. The LED, along with the anode and cathode, form an integrated module that can be assembled in an independent plastic insulation support or directly assembled in a multi-modular support with the form of the lamp.

Figure 1:
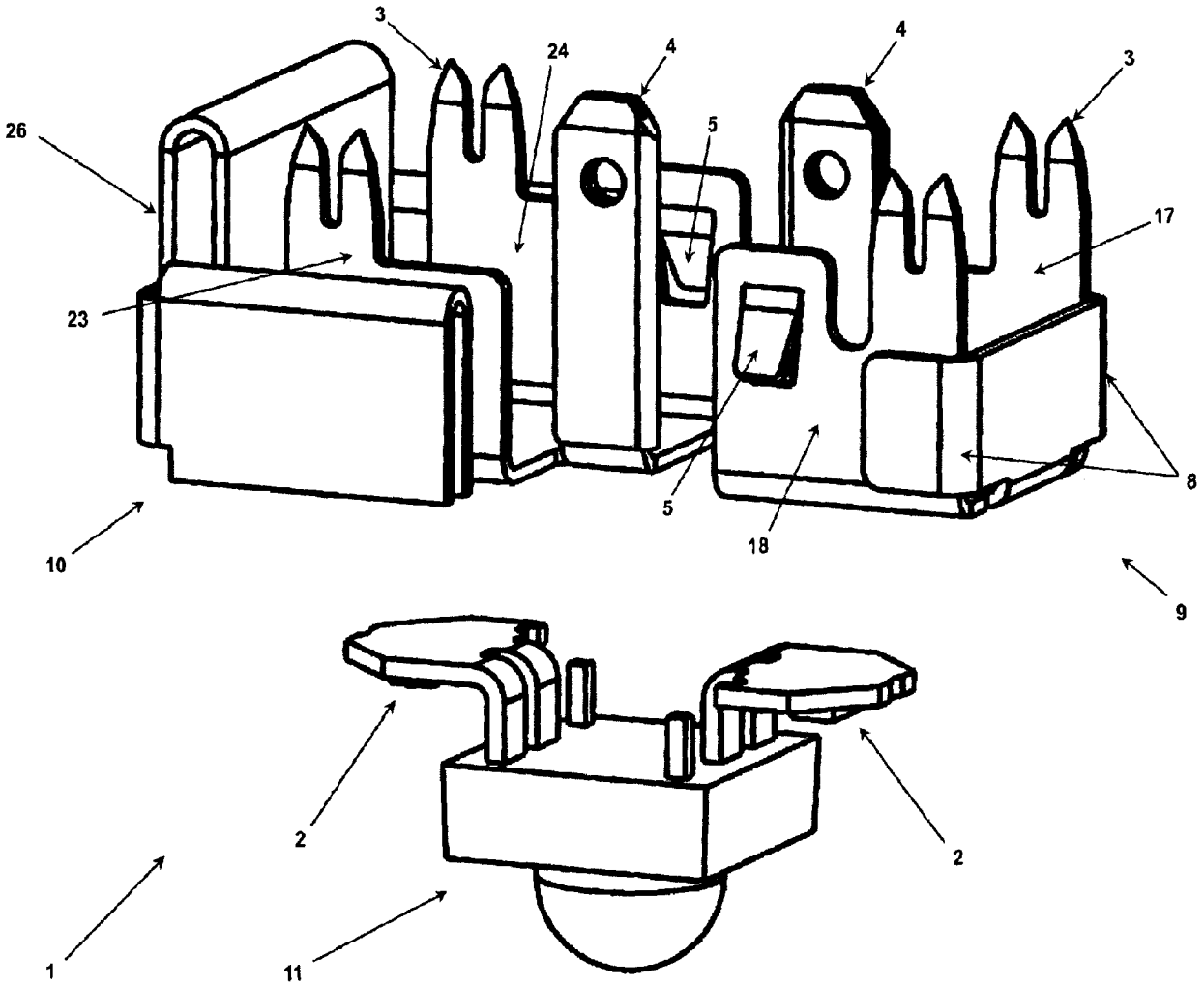
FIG. 1 Lower view of the anode, cathode and LED diode before the attachment.
Figure 2:
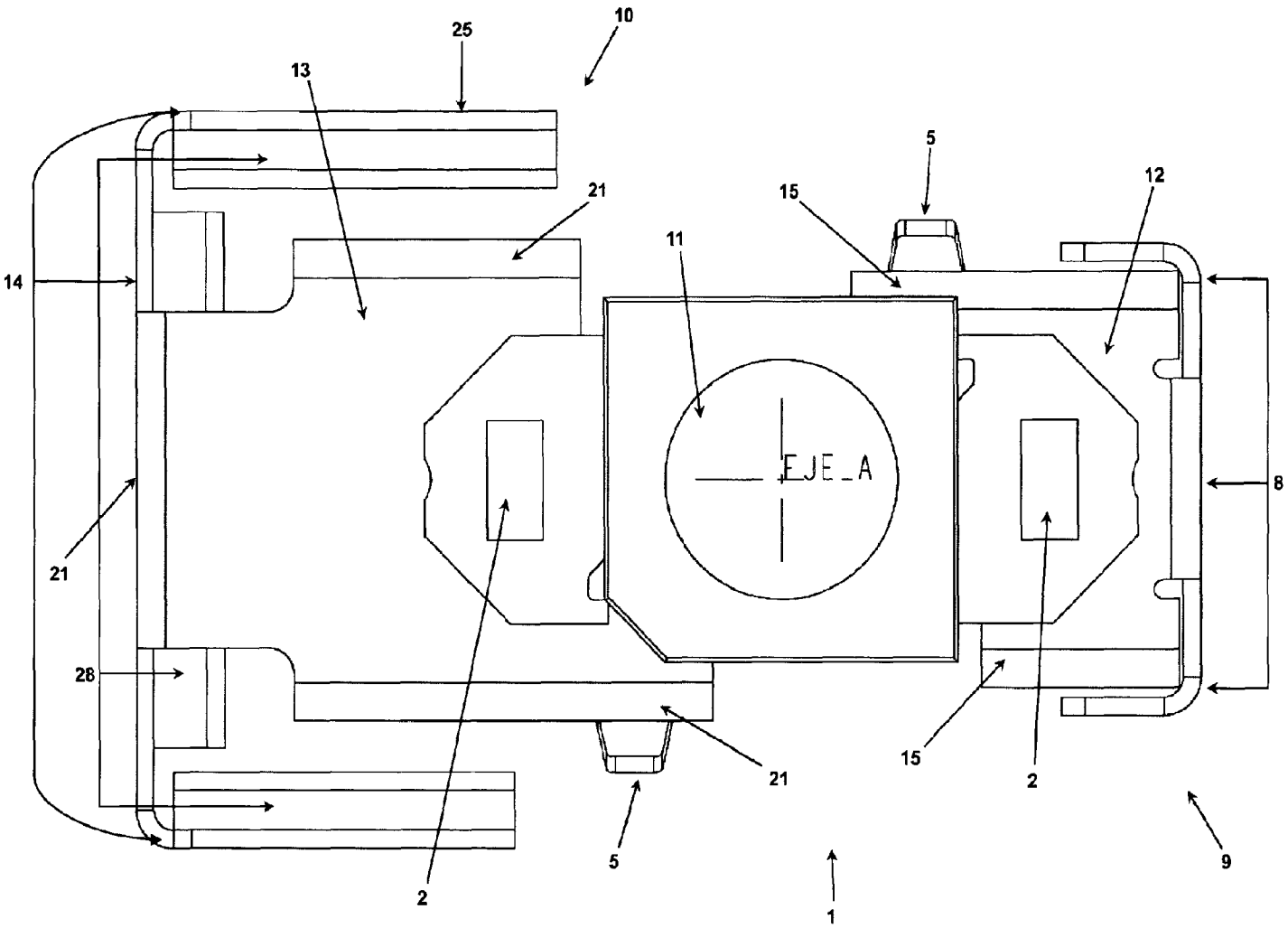
FIG. 2 Upper view of the device or module assembled with the LED attached by a conventional attachment process FIG. 3 Exploded view of the module and the individual insulation base before the attachment.
Figure 3:
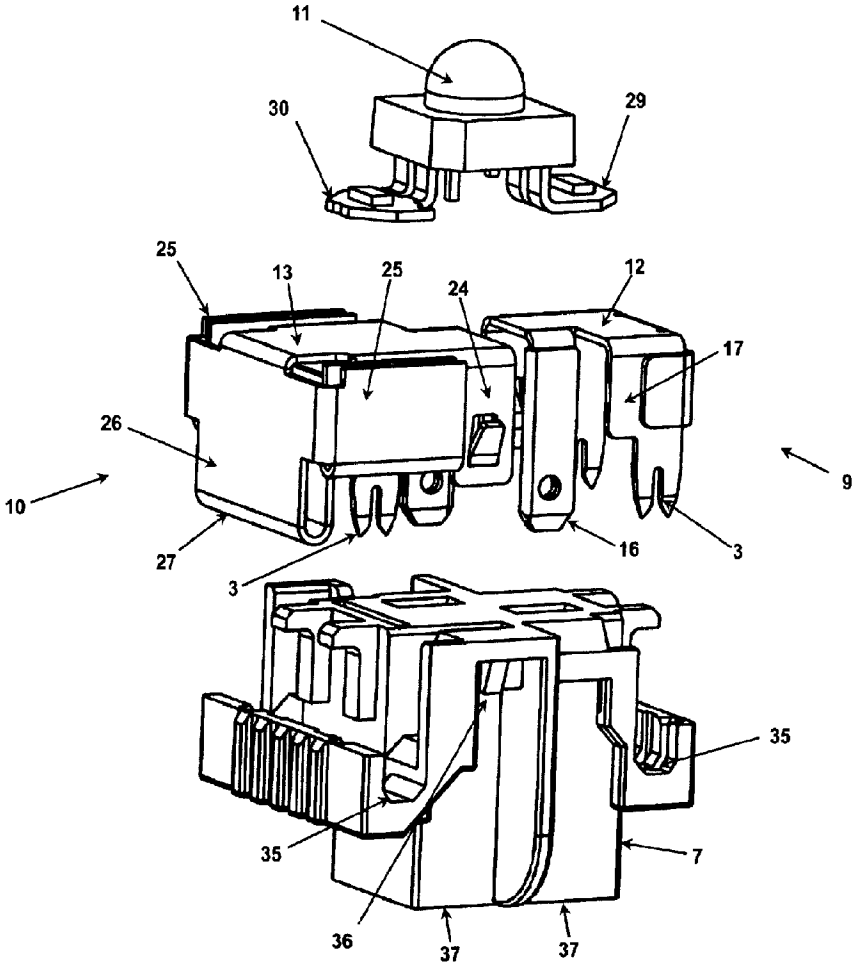
Figure 4:
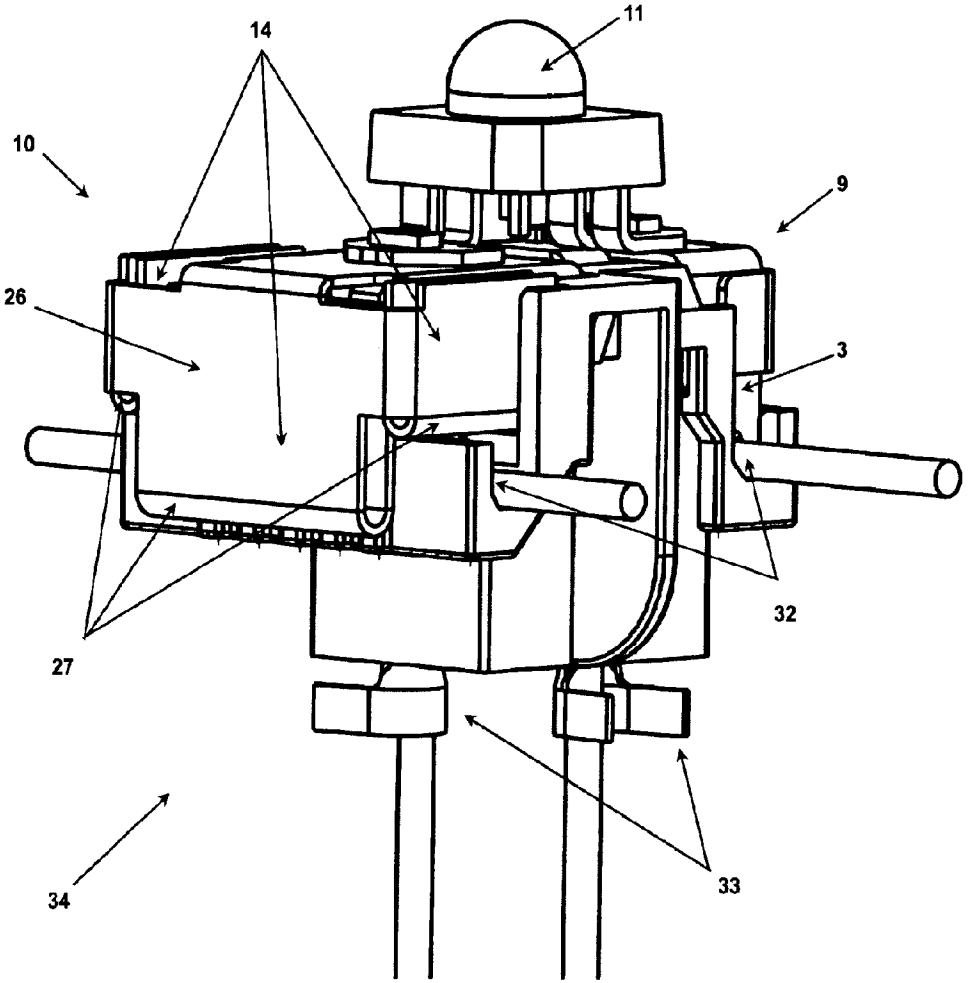
FIG. 4 Connection possibilities using the module along its insulation base.
Figure 5:
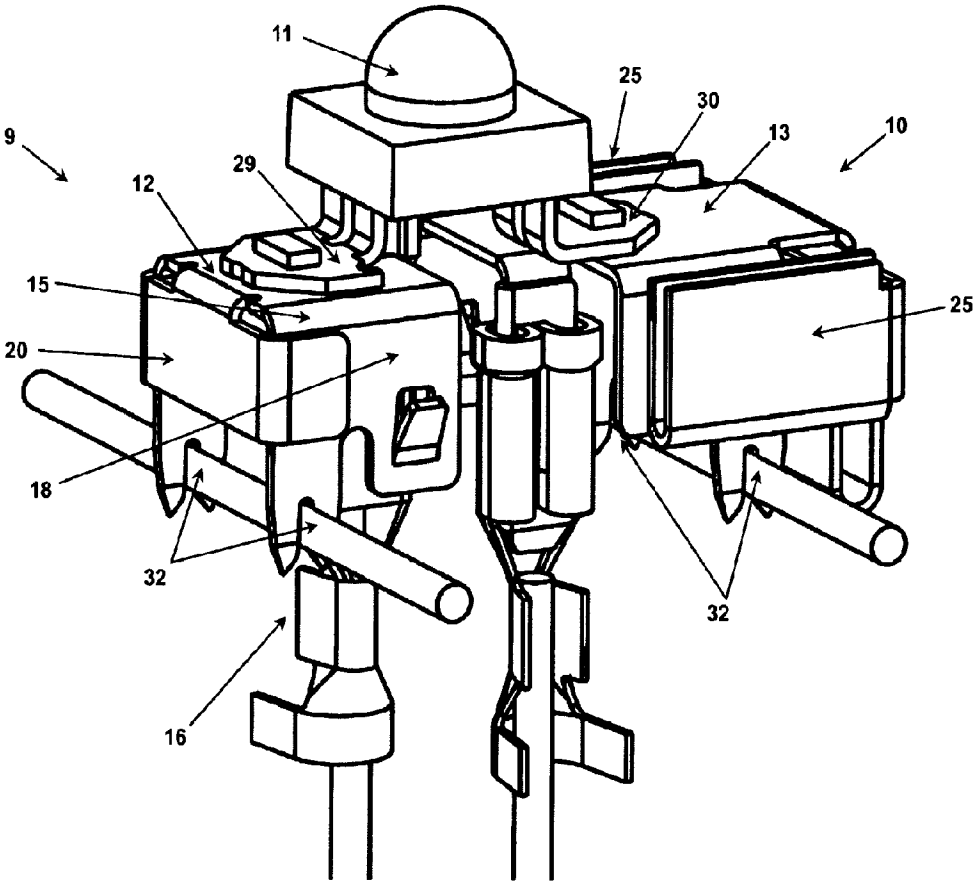
FIG. 5 Connection possibilities of the module without the insulation base.
Figure 6:
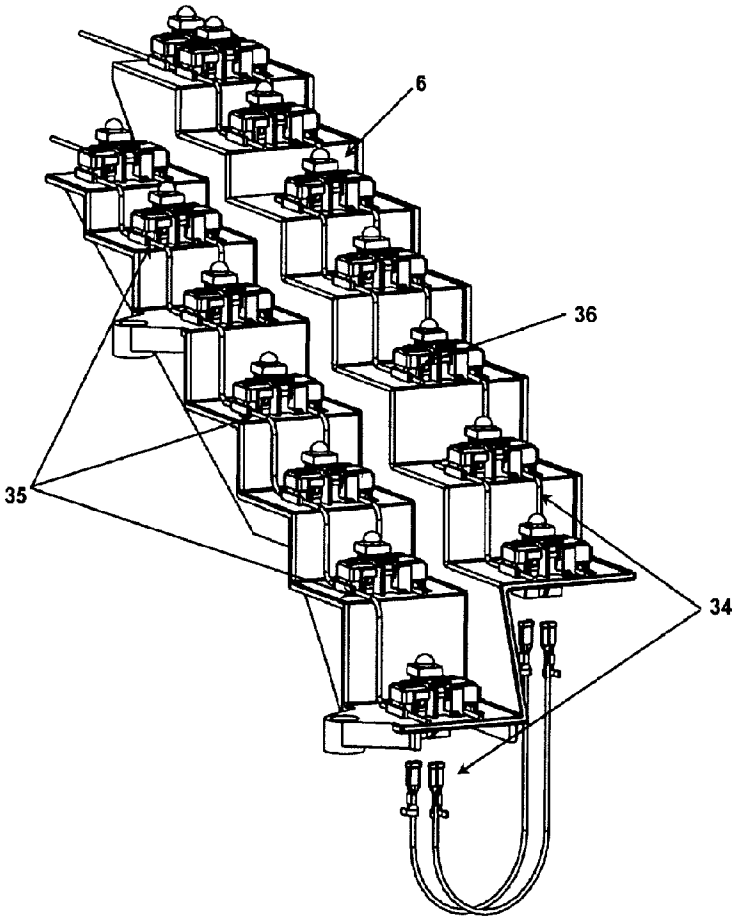
FIG. 6 Module attachment over the base with capacity for multiple modules.

The invention comprise one module (1) created with an anode (9), a cathode (10) and LED diode (11), in which the LED is anchored by means of a conventional method, preferably by mechanical stapling (2) to the anode and cathode.

The Anode (9) and the Cathode (10) in the invention comprise two different electrical connection forms; being these the insulation displacement route (3) and connection by terminals (4). Likewise, the anode and cathode incorporate a clasp mechanism (5) for the anchoring and attachment in a multi-modular base (6) or over an individual insulation base (7).

The anode also incorporates a series of bending in the conductor material for the placement of the connection terminals and the packaging and structural rigidity of the module (8). The cathode also incorporates a series of bending in the conductor material for the placement of the connection terminals, the packaging and structural rigidity of the module and surfaces for heat dissipation.

DETAILED DESCRIPTION OF THE INVENTION

The purpose of this invention is a module that comprise two metallic or conductor pieces, Anode (9) and Cathode (10) and one or more LED-type diodes (11).

The anode (9) is created as from metallic plate printed or bent to create the connectors (3) and (4), the attachment surface of the LED (12), the structural rigidity area (8) and the anchoring clasp (5).

The cathode (10) is created as from metallic plate printed or bent to create the connectors (3) and (4), the attachment surface of the LED (13), the heat dissipation area (14) and the anchoring clasp (5).

Figure 10:
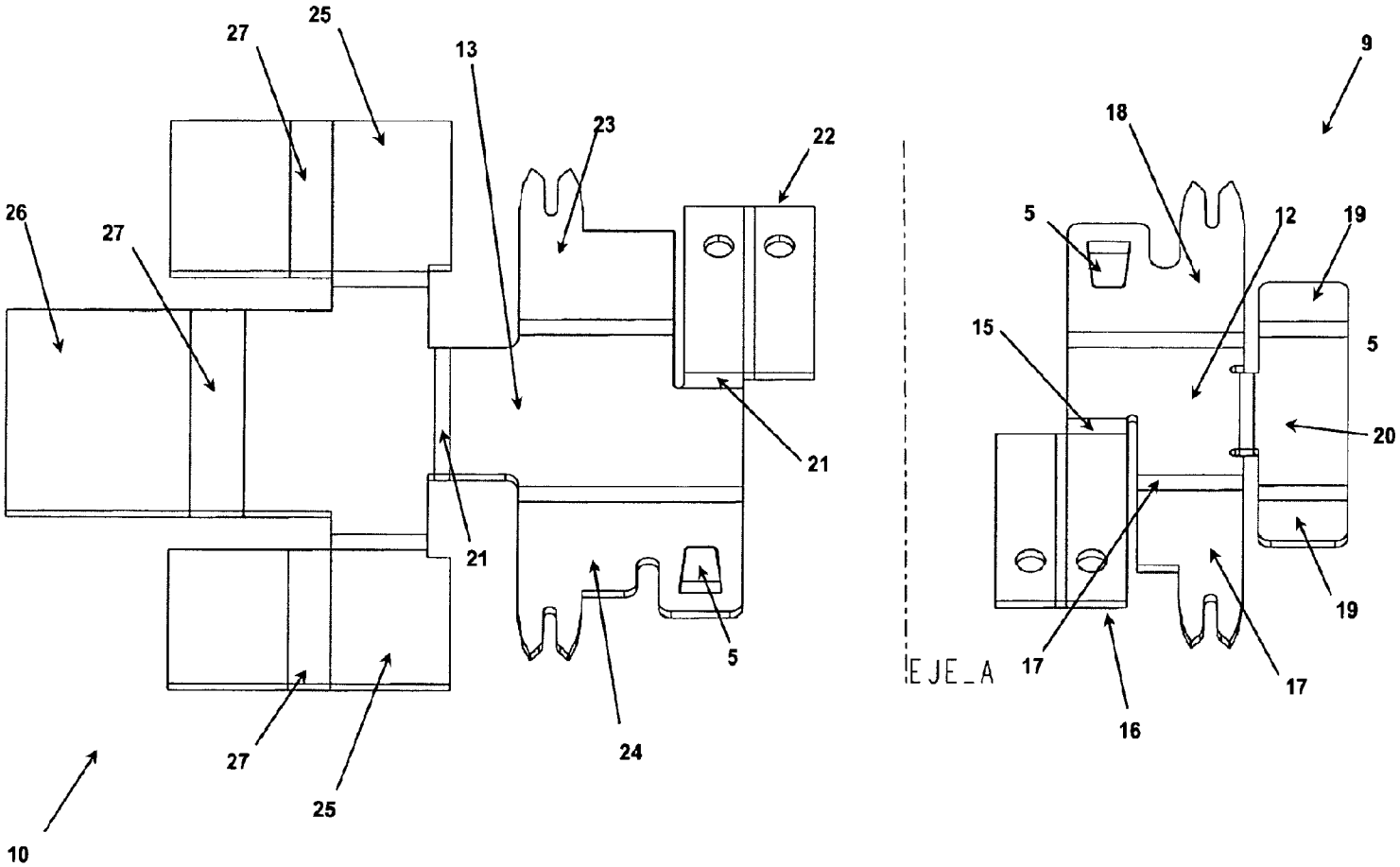
FIG. 10 Form of the anode and cathode before bendings.
Figure 11:
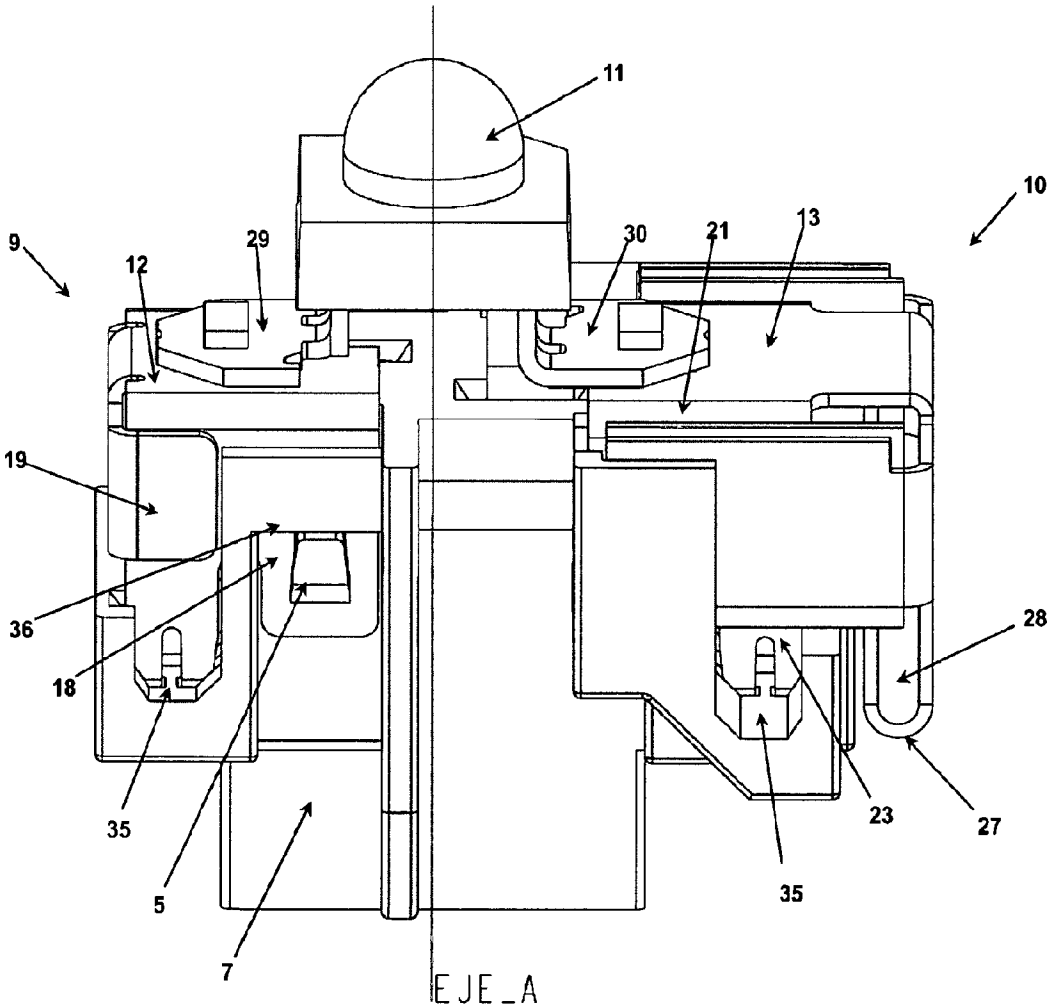
FIG. 11 Lateral view of the module
Figure 12:
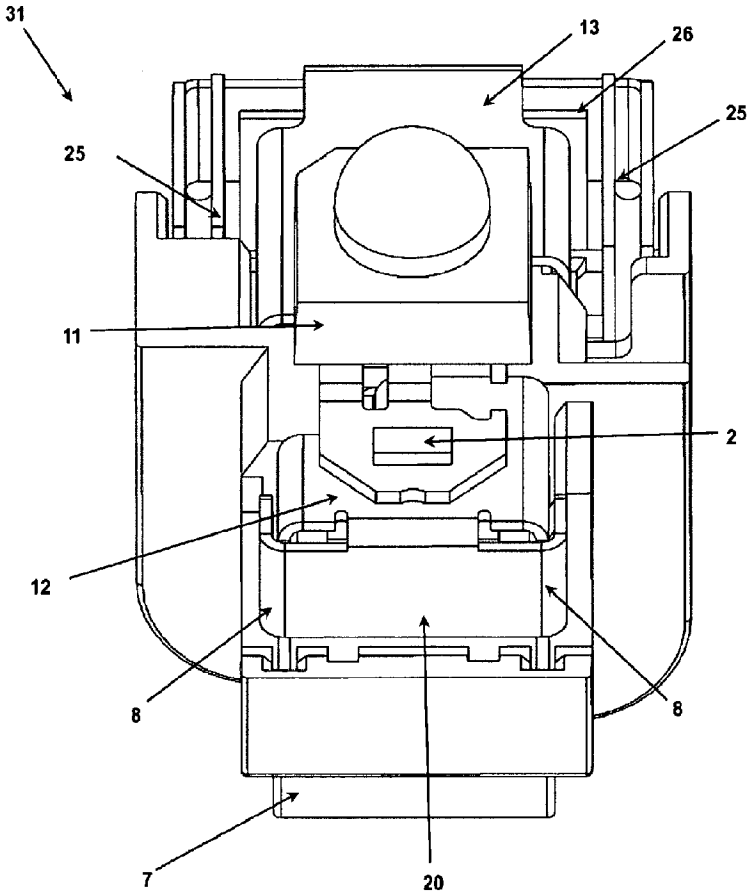
FIG. 12 Front-upper view of the module
Figure 13:
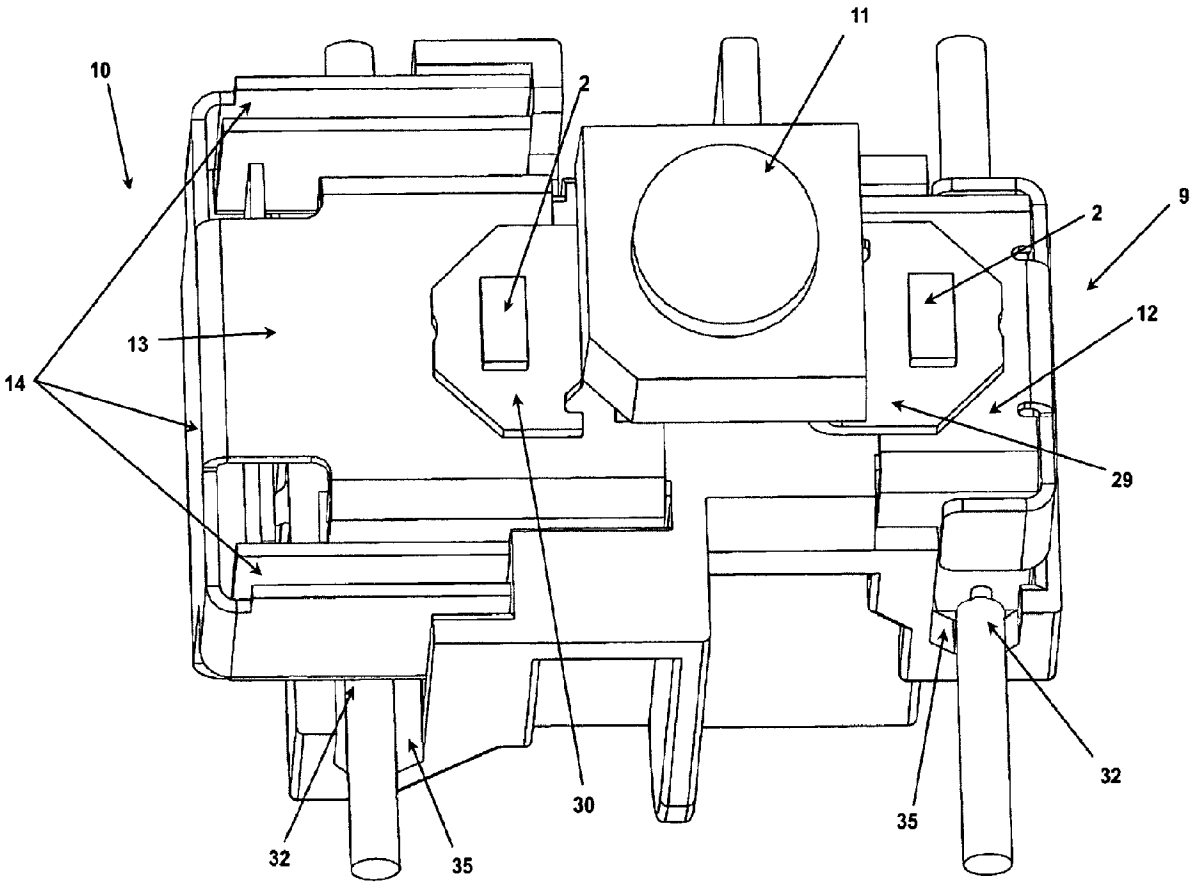
FIG. 13 Upper-lateral view of the module

The creation of the anode (9) involves the creation of the terminal as from the bending in 180 degrees of the plate in the point (15), creating the anode connection terminal. Over this terminal (16), an additional bending is performed in a perpendicular manner to the LED attachment surface (12), remaining in a parallel form to the Axis A (FIG. 10). In the same manner, the bending of the insulation displacement connection 1 bending is performed (17), remaining equally parallel to Axis A (FIG. 10). The second insulation displacement connection 2 (18), that incorporates the clasp (5) is perpendicularly bent to the surface (12), remaining in the same orientation in Axis A (FIG. 10) than the previous bendings. The surface laterals (19) are bent in a perpendicular manner to the surface, remaining parallel to Axis A and in the same orientation than the other bendings. The anode is finished with the bending of the central surface (20), remaining perpendicular to the attachment surface of the LED (12) and parallel to the Axis A, with the lateral surfaces (19) on the sides of the displacement connections of the cable (17) and (18), maintaining the form and providing structural rigidity to the anode.

The creation of the cathode (10) involves the creation of the terminal as from the bending in 180 degrees of the plate in the point (21), creating the cathode connection terminal. Over this terminal (22), an additional bending is performed in a perpendicular manner to the LED attachment surface (13), remaining in a parallel form to Axis A (FIG. 10). In the same manner, the bending of the insulation displacement connection 1 bending is performed (23), remaining equally parallel to Axis A (FIG. 10). The second insulation displacement connection 2 (24), which incorporates the clasp (5) is perpendicularly bent to the attachment surface of the LED (13), remaining in the same orientation in the Axis A (FIG. 10) than the previous bendings.

The surfaces for the lateral (25) and central (26) heat diffusion are bent forming a 180 degrees angle, remaining parallel to the original surface and with a curvature radius (27) that allow the air flow between both surfaces (28). These surfaces are bent, remaining in a perpendicular form to the attachment surface of the LED (13) and the lateral surfaces (25) are bent toward the interior or the exterior of the lamp, framing the contact surface with the LED. The bending of the heat transference surfaces (27) allow increasing the area of the heat conductor material for a better thermal dissipation, keeping the LED (11) in an acceptable operation temperature.

The illumination diode or LED (11) has two electrical contacts (29) and (30). These are joined to the attachment surfaces of the led in the anode (12) and cathode (13) by means of a conventional attachment system, preferably in a stapled method in a manner that the anode (9) and cathode (10) have an electric continuity with the LED terminals (29) and (30). The anode, cathode and the attached LED form the module for the LED lamp (1).

The module presents two connection possibilities in an electrical circuit. The first form is by means of insulation displacement connections (3). Both the anode (9) and the cathode (10) have insulation displacement connections (3) which operate in a blade form over the insulation material of a conventional cable, remaining in direct contact with the conductor material of the cable and performing the direct connection to the LED diode. This type of connection may be used with the individual module (1) or jointly with the individual insulation base for the module (31), where the insulation base that may be plastic (7) acts as a support for the cable at the moment of performing the connection.

The second connection possibility is through the conventional terminals. Both the anode (9) and the cathode (10) have conventional terminal connections (4) in which the cables with terminals may be connected, feeding the LED terminals (29) and (30) through the anode (9) and the cathode (10).

The existence of both types of connections in a simultaneous manner allow that the lamp may be connected to a circuit or to more lamps by means of the insulation displacement connections (32), by conventional terminals (33) or by a combination of both (34).

The module (1) may be directly attached to the application over an insulation material base that may have the capacity for one or several LED modules attached in a specific form or array (6). The module has anode and cathode clasps (5) for its anchoring, while the electrical connection may be by insulation displacement (3) or through cables connected to the terminals (4).

Additionally, the module can be attached in an individual insulation material base (7) or in a multi-modular base (6); the anode and cathode are maintained physically separated in both of them and allows more attachment possibilities in different applications. Such base has a space for the placement of conductor cables (35), confining the cable for an adequate actuation of the insulation displacement connections (3). Likewise, it has supports for the module attachment (36), offering the support point for the mechanical clasps (5) of the anode and cathode. The lower part has spaces for the placement of conventional terminals (37), in which, in addition of having the space for the placement of terminals, it offers support and resistance both at the module terminal as well as to the terminals of the electric circuit.

Figure 7:
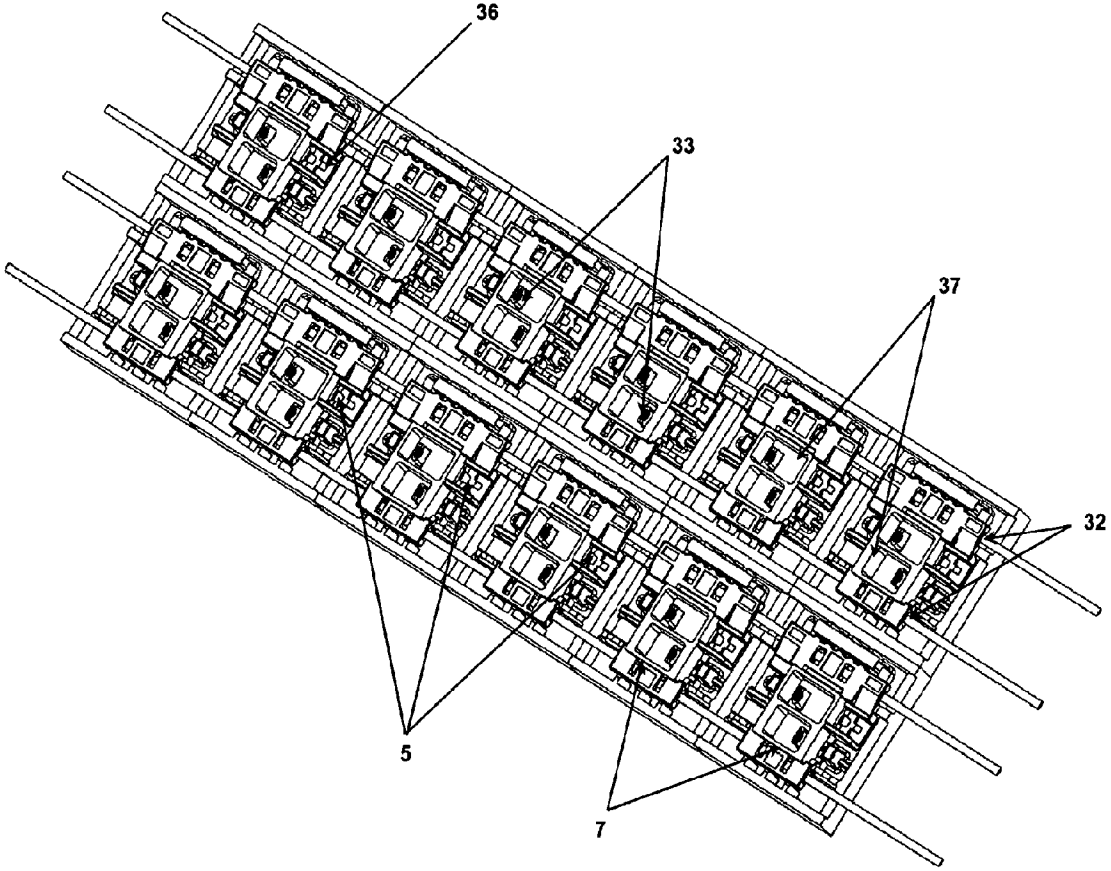
FIG. 7 Lower view of the modules with the individual insulation attachment.
Figure 8:
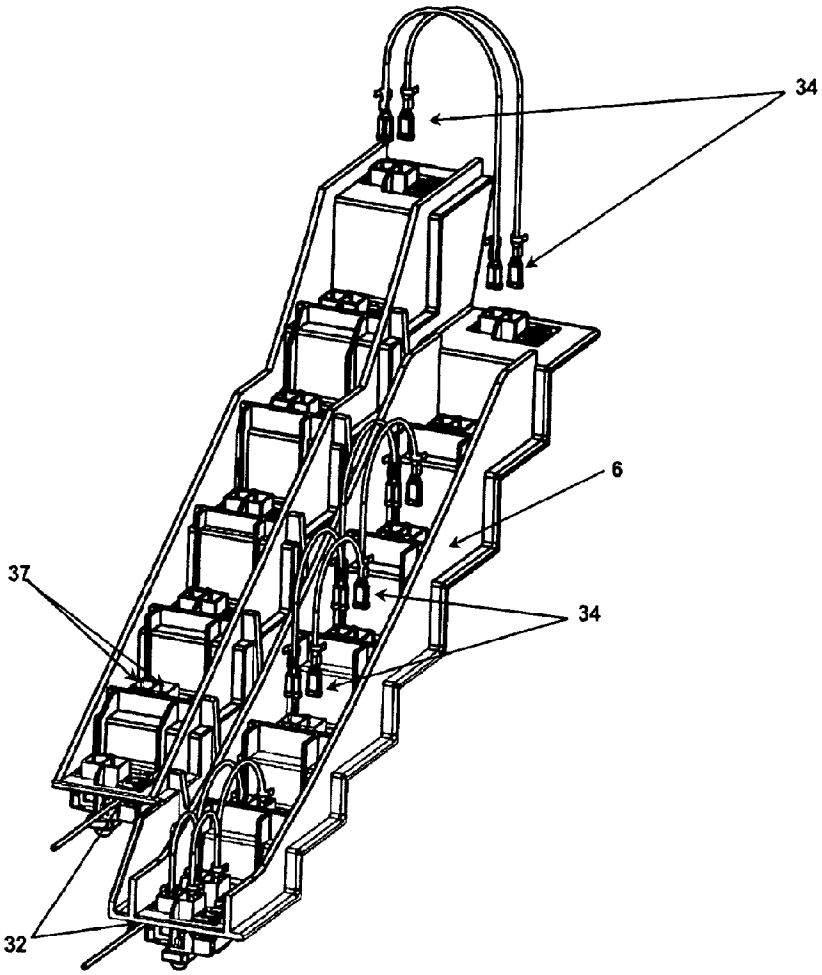
FIG. 8 Connection possibilities of modules attached over bases with capacity for multiple modules.
Figure 9:
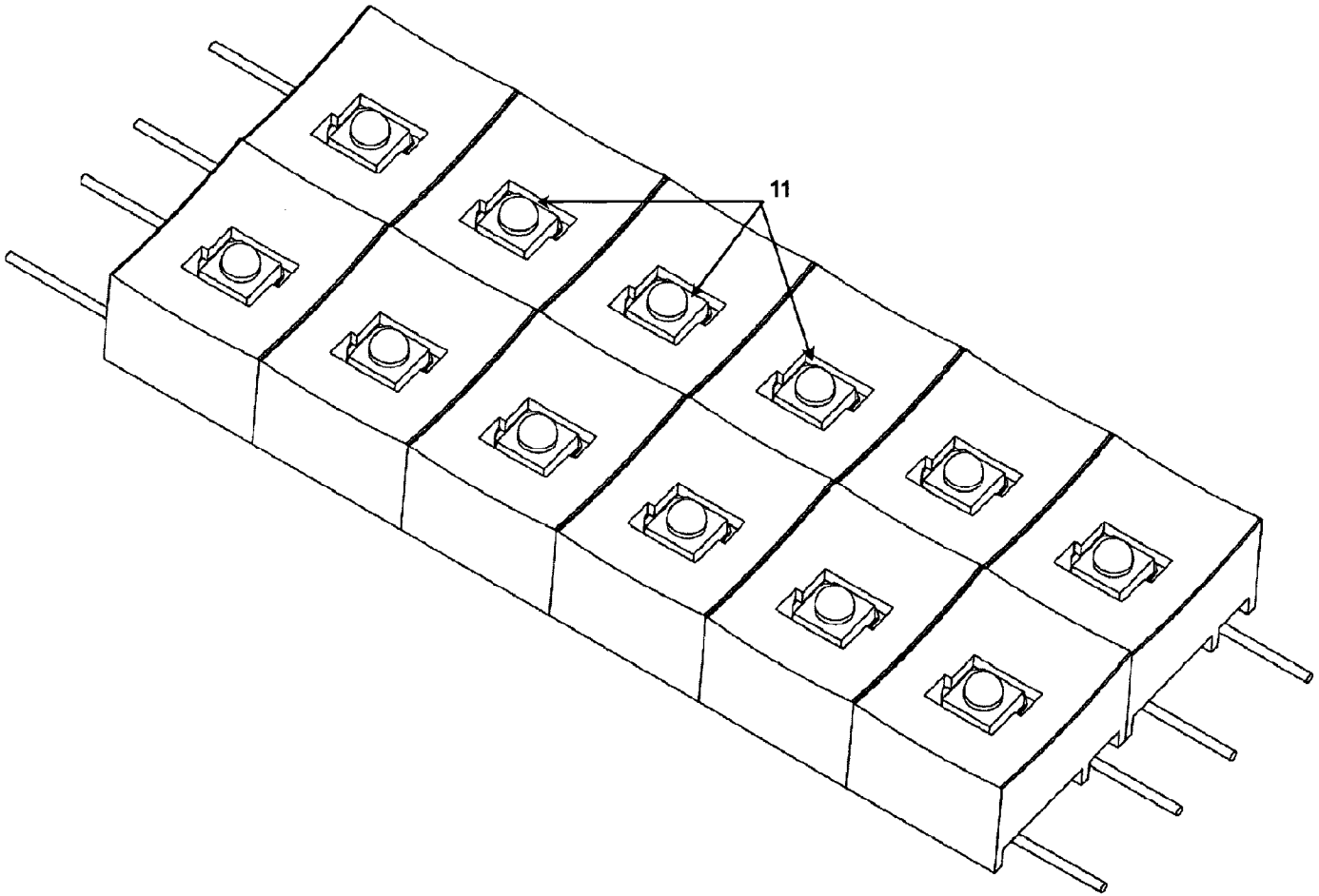
FIG. 9 Upper view of the modules with individual insulation base attached.

The module with its insulation base (31) may be attached to lamps or luminaries directly and in orientations and various dispositions (FIG. 7), either with a connection in the insulation displacement base (32), a connection based on terminals (32) or a combination of both (34.)

What is claimed is:

1. A LED lamp module comprising:

a) a base, b) a cathode comprising:

(i) two insulation displacement connections each comprising:

a flat surface portion having a proximal edge adjacent to the base and a distal edge distal to the base; and a connecting portion extending from the distal edge of the flat surface portion toward the base to provide an connection with a conductor cable;

(ii) a terminal;

(iii) a lateral heat diffusion surface; and (iv) a central heat diffusion surface perpendicular to the lateral heat diffusion surface, wherein the lateral heat diffusion surface and the central heat diffusion surface are respectively bent in an opposite direction to form a curvature radius and two heat diffusion surfaces separated by the curvature radius, said two heat diffusion surfaces facing each other and forming a s ace between said heat diffusion surfaces so that air flows between said heat diffusion surfaces; and c) an anode comprising:

(i) two insulation displacement connections each comprising:

a flat surface portion having a proximal edge adjacent to the base and a distal edge distal to the base; and a connecting portion extending from the distal edge of the flat surface portion toward the base to provide a connection with a conductor cable; and (ii) a terminal.

2. A LED lamp module according to claim 1, further comprising a fastener for quick attachment on each of the anode and the cathode.

3. A LED lamp module according to claim 1, wherein each of the anode and cathode of the module are formed from corresponding metallic plates, in which the terminals and insulation displacement connections, heat diffusion surfaces, and structural reinforcement have been pre-stamped surrounding a flat surface where the LED anode/cathode would be attached, and wherein the anode and cathode from the module are obtained from bending the respective pre-stamped along established bend lines, and once obtained they are attached to the anode and cathode of the LED lamp respectively.

4. A LED lamp module according to claim 1 wherein the anode and cathode are manufactured from one plate-type conductor piece.

5. A LED lamp module according to claim 1, wherein the lateral and central heat diffusion surfaces of the cathode are placed around the cathode in a rectangular form.

6. A LED lamp module according to claim 2, wherein the fastener is a clasp-type hook for a quick attachment.

7. A LED lamp module according to claim 1, wherein the base electrically separates the anode and cathode and offers support for the insulation displacement connections and a through terminal.

8. A LED lamp module according to claim 7, wherein the base comprises slots which integrate counter-supports for quick-attachment clasps.

9. A LED lamp module according to claim 7, wherein the base comprises slots over which the lateral and central heat diffusion areas of the LED lamp module are placed.

10. A LED lamp module according to claim 7, wherein the base further comprises spaces for the placement of cable and serves as a support for the connection of the insulation displacement terminals.

11. A LED lamp module according to claim 7, wherein the base further comprises lower spaces for the connection of terminals to the LED lamp module.

* * * * *